US010718141B2

(12) United States Patent
Battenfield et al.

(10) Patent No.: US 10,718,141 B2
(45) Date of Patent: Jul. 21, 2020

(54) DOOR BARRICADE SYSTEM

(71) Applicants: Jeremy D. Battenfield, San Antonio, TX (US); Edgar Wolf, Nederland, TX (US)

(72) Inventors: Jeremy D. Battenfield, San Antonio, TX (US); Edgar Wolf, Nederland, TX (US)

( * ) Notice: Subject to any disclaimer, the term of this patent is extended or adjusted under 35 U.S.C. 154(b) by 398 days.

(21) Appl. No.: 15/589,899

(22) Filed: May 8, 2017

(65) Prior Publication Data

US 2017/0321457 A1 Nov. 9, 2017

Related U.S. Application Data

(60) Provisional application No. 62/332,924, filed on May 6, 2016.

(51) Int. Cl.
*E05C 9/04* (2006.01)
*E05C 9/06* (2006.01)
*E05C 9/08* (2006.01)

(52) U.S. Cl.
CPC ..... *E05C 9/043* (2013.01); *E05C 9/06* (2013.01); *E05C 9/085* (2013.01)

(58) Field of Classification Search
CPC ... E05C 9/06; E05C 9/16; E05C 9/043; E05C 19/001; E05C 9/02; E05C 9/10; E05C 7/045; E05C 9/046; Y10T 292/0801; Y10T 292/0892; Y10T 70/523; Y10T 292/0921; Y10T 292/282; Y10T 70/5115; Y10T 70/5208; Y10T 70/5248
See application file for complete search history.

(56) References Cited

U.S. PATENT DOCUMENTS 2,594,253 A * 4/1952 Vander Veer ..... B60J 9/02 292/92
2,823,536 A * 2/1958 Watson ..... E05B 65/0082 70/1.5
3,637,277 A * 1/1972 Krug ..... E05B 65/0082 312/217
4,046,410 A * 9/1977 Connell ..... E05C 9/06 292/36
4,754,715 A * 7/1988 Squires ..... E05B 65/0075 109/59 T
5,340,172 A * 8/1994 Sweet ..... E05C 19/003 292/259 R
5,778,708 A * 7/1998 Crosby ..... E05B 65/0075 109/59 R
6,000,732 A * 12/1999 Scheler ..... H01L 21/67373 292/68

(Continued)

*Primary Examiner* — Mark A Williams

(57) ABSTRACT

A compact door barricade apparatus for use on doors is described. The apparatus is equipped with a protective inner case, outer case, door mount, an upper barricade, a lower barricade, barricade pivot links, handles, and barricade latches. Screws or lag bolts are used to mount the barricade latches to the door frame. The door mount connects the apparatus to the door. The barricade pivot links effectively link the movement of the upper barricade to that of the lower barricade. The movement of the handle disposed on the apparatus facilitates the synchronous movement of the upper and lower barricades across the width of the door and door frame, effectively securing individuals within a room.

11 Claims, 6 Drawing Sheets

(56) References Cited

U.S. PATENT DOCUMENTS

| | | | | |
|---|---|---|---|---|
| 7,350,837 | B1 * | 4/2008 | Faires | E05C 19/003<br>292/259 R |
| 2008/0157541 | A1 * | 7/2008 | Olsen | E05C 9/06<br>292/34 |
| 2008/0157542 | A1 * | 7/2008 | O'Neill | E05C 9/06<br>292/37 |
| 2015/0191949 | A1 * | 7/2015 | Wilson | E05C 19/003<br>292/259 R |
| 2015/0376923 | A1 * | 12/2015 | Presutti | E05C 19/005<br>49/506 |

* cited by examiner

DOOR BARRICADE SYSTEM

CONTINUITY

This application is a non-provisional application of provisional patent application No. 62/332,924, filed on May 6, 2016, and priority is claimed thereto.

FIELD OF THE PRESENT INVENTION

The present invention relates generally to door locking devices, and more specifically relates to an interior barricade system fit for use on residential and commercial doors.

BACKGROUND OF THE PRESENT INVENTION

While many means of securing doors are available on the market today, most involve the use of a physical or mechanical lock. Locks are often present on door knobs and deadbolts, which conventionally may be unlocked from either side of the door. Locks such as these are useful in locations that require secured access that is semi-public, in that any individual equipped with a key to the lock may gain access though either side of the door.

Unidirectional or barricade-type locks differ from conventional deadbolt or door knob locks in that they are used to secure a person within a room or behind a door. These types of locking mechanisms include door chains, slide locks, and latches. These physically bind the door to the door frame temporarily, providing a seemingly more secure form of lock which may only be locked or unlocked from within the secure area behind the door. This concept of secure locking is popular, as barricade locks work to prevent an intruder or unwanted individual from opening the door from the outside. No keys are used, meaning ideally, only those behind the door may open the door.

Unfortunately, many conventional locks are weak, as they only attach to an edge or corner of the door. As one may imagine, a chain, slide lock, or similar lock can easily be broken when sufficient force is applied to the correct portion of the door from the outside. As these locks are fairly common, most individuals know where the lock is located, and can therefore apply three in the proper place to defeat the lock.

Additionally, as many of these locks are installed at or near the top portion of the door, shorter individuals, people confined to wheelchairs, and children cannot often reach them, and are therefore unable to use them. A locking mechanism that could be locked or unlocked from the middle or lower portion of the door would make it easy for more people to use the lock for safety and security. A locking mechanism that could be locked or unlocked from the middle or lower portion of the door would make it easier for such people to use the locking mechanism for safety and security. Furthermore, conventional barricades that employ wood or metal bars secured by barricade latches are often heavy, and may not be easily lifted by many individuals. A barricade that does not require lifting would facilitate easier use of such device, and provide greater protection than weaker conventional locks.

Thus, there is a need for an apparatus that provides better protection than conventional locks, is designed for everyday use, is easily locked and unlocked by all individuals without heavy lifting, and effectively secures a door from intruders. Such an apparatus preferably employs multiple barricade portions which extend across the entirety of the door and door frame. The multiple barricade portions are preferably linked such that they may be latched and unlatched simultaneously, expediting the arming and disarming of the barricade.

SUMMARY OF THE PRESENT INVENTION

The present invention is a multi-point barricade for use on residential and commercial doors. The apparatus includes an upper barricade, a lower barricade, pivot links, at least one actuating handle, a door mount, and barricade latches. An alternate embodiment of the present invention includes rotary actuators configured to rotate about a central axis to facilitate the extension and retraction of the upper barricade and lower barricade into the barricade latches simultaneously.

BRIEF DESCRIPTION OF THE DRAWINGS

The present invention will be better understood with reference to the appended drawing sheets, wherein.

DETAILED DESCRIPTION OF THE PREFERRED EMBODIMENT

Figure 1:
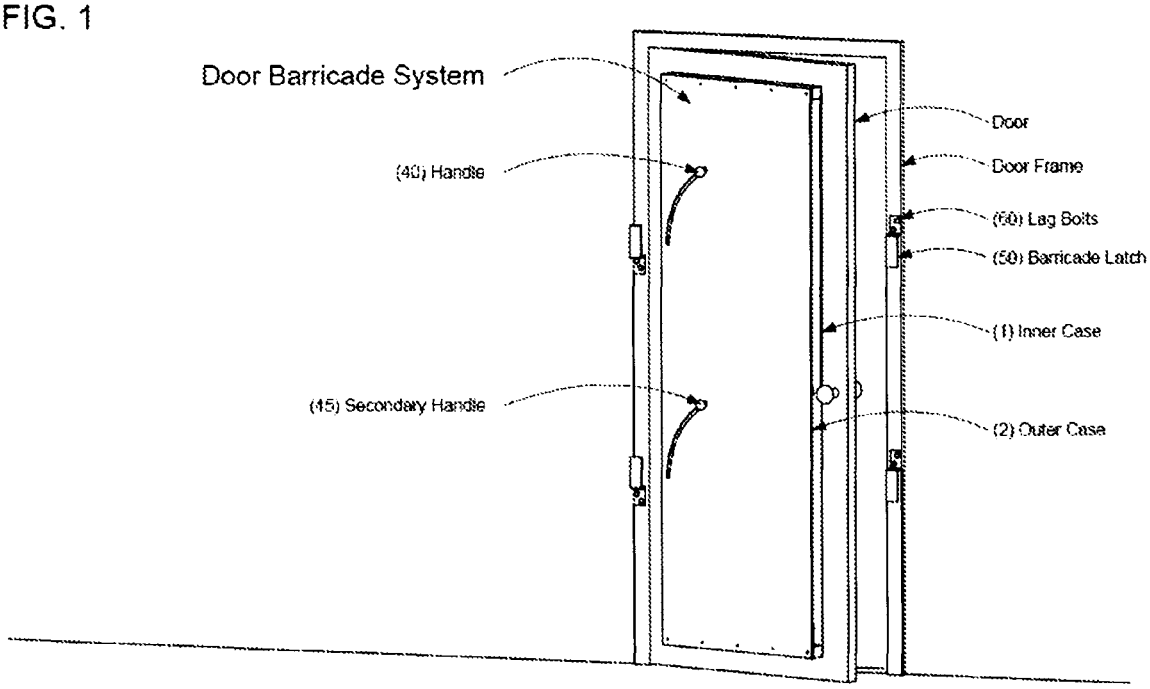
FIG. 1 shows a frontal view of the present invention in the unlocked position.
Figure 2:
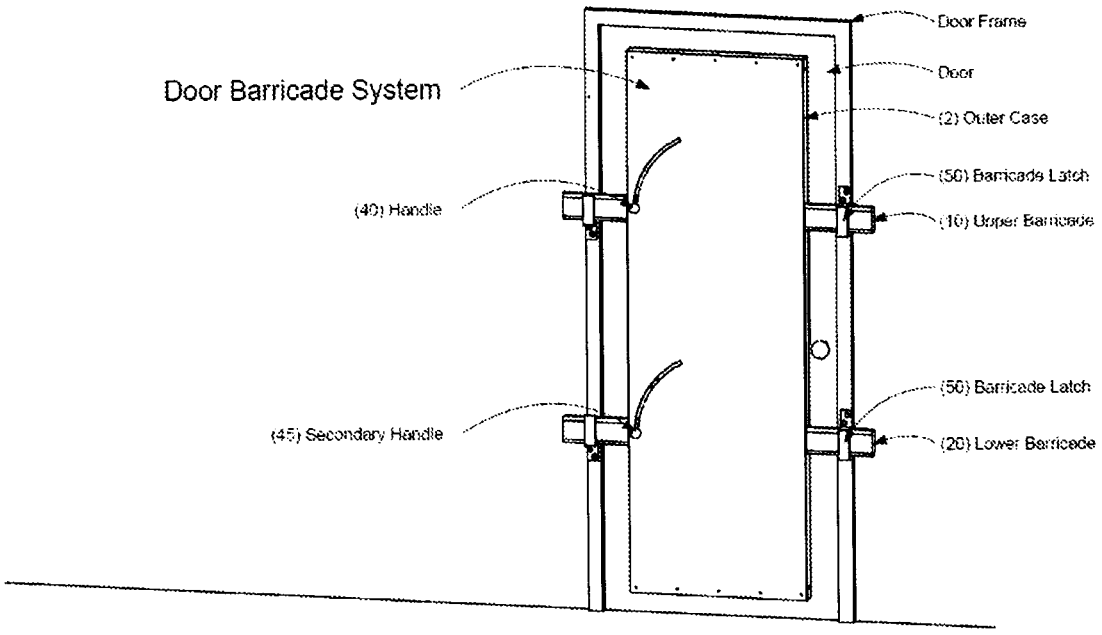
FIG. 2 shows a frontal view of the present invention in the locked position.
Figure 3:
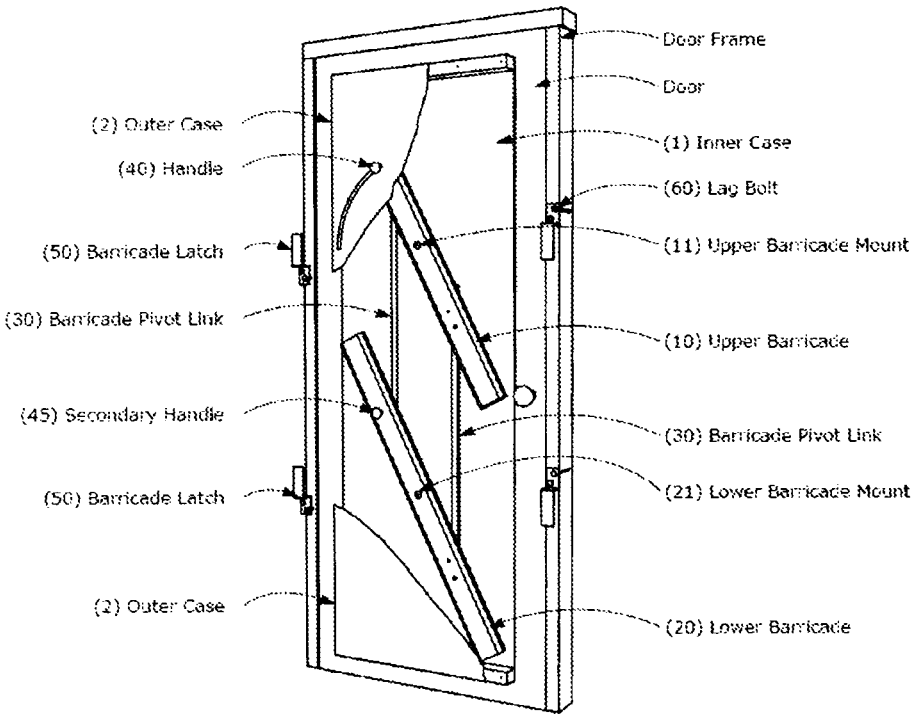
FIG. 3 shows the internal components, to include the upper and lower barricades and pivot links.

Referring to the drawings and the characters of reference marked thereon, FIG. 1 through FIG. 6 illustrate the barricade system of the present invention. The system is preferably equipped with the following components:

Inner Case (1)
Outer Case (2)
Door Mount (not shown)
Upper Barricade (10)
Upper Barricade Mount (11)
Lower Barricade (20)
Lower Barricade Mount (21)
Barricade Pivot Links (30)
Circular Actuator—Middle (31)
Circular Actuator—Upper (32)
Circular Actuator—Lower (33)
Handle (40)
Secondary Handle (45)
Barricade Latches (50)
Screws or Lag Bolts (60)

There are preferably three primary embodiments of the present invention. The first embodiment of the present invention is detailed in FIG. 1 through FIG. 3. As shown, the first primary embodiment of the present invention is enclosed in a protective case. The Inner Case (1) and Outer Case (2) house the Upper Barricade (10), Upper Barricade Mount (11). Lower Barricade (20), Lower Barricade Mount, and Barricade Pivot Links (30).

The Upper Barricade (10) is fastened to, and rotates about the Upper Barricade Mount (11). The Lower Barricade (20)

is fastened to, and rotates about the Lower Barricade Mount (21). The Upper Barricade (10) and Lower Barricade (20) are linked together with Barricade Pivots Links (30) to facilitate synchronous movement between the Upper Barricade (10) and Lower Barricade (20).

A Handle (40) attaches to the Upper Barricade (10), and the Secondary Handle (45) attaches to the Lower Barricade (20). As the Handle (40) or Secondary Handle (45) are lowered, the Upper Barricade (10) and Lower Barricade (20) rotate simultaneously into the locked position, effectively positioning the Upper Barricade (10) and Lower Barricade (20) inside of the Barricade Latches (50), securing the individuals inside the room. As the Handle (40) or Secondary Handle (45) are raised, the Upper Barricade (10) and Lower Barricade (20) simultaneously rotate into the unlocked position.

Figure 4:
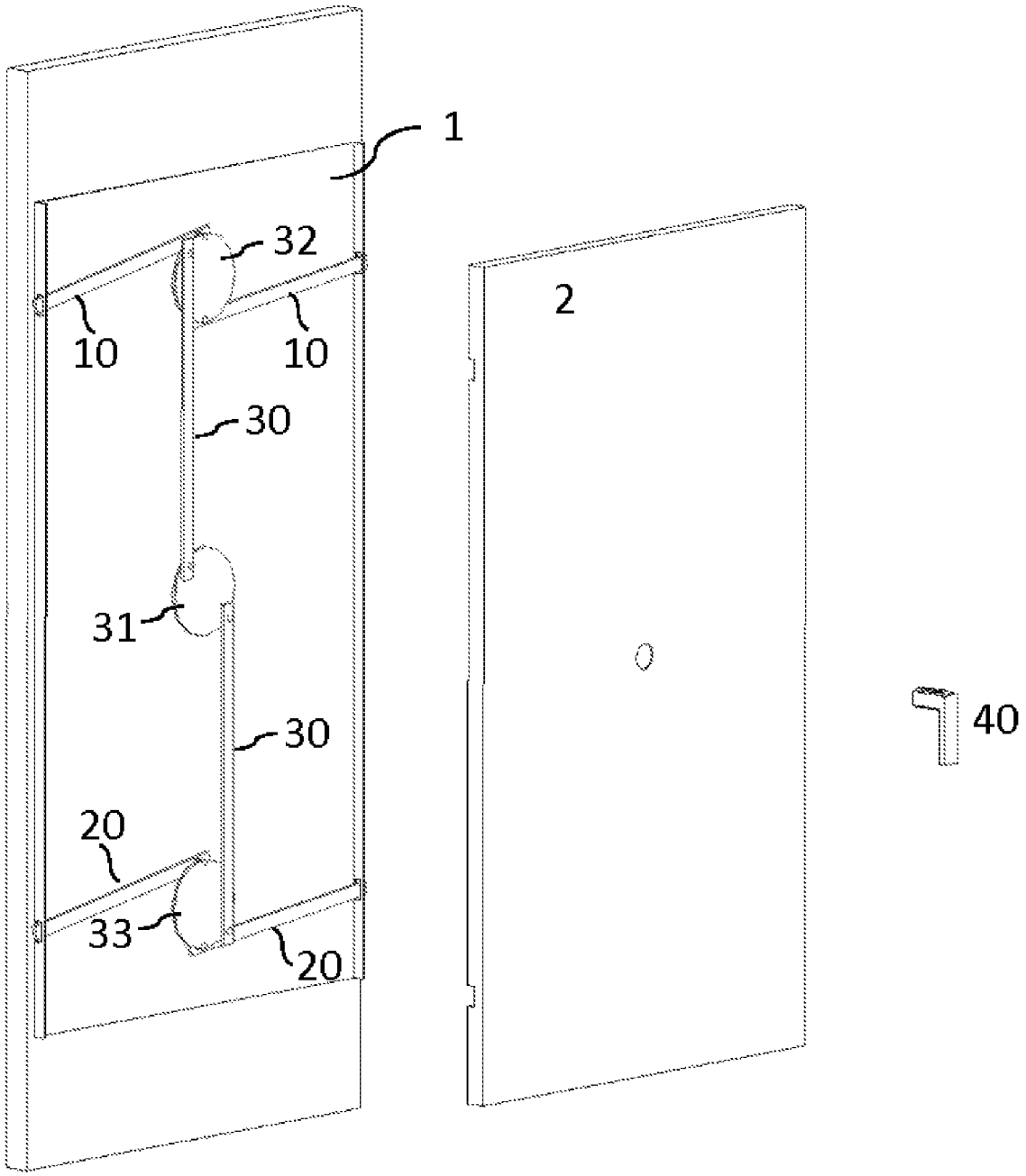
FIG. 4 shows a frontal view and the internal components of the second preferred embodiment in the unlocked position.

The second preferred embodiment of the present invention, shown in FIG. 4, employs another method of actuation. A combination of circular actuators rotate about a central axis to facilitate the simultaneous locking and unlocking of the Upper Barricade (10) and Lower Barricade (20). The Handle (40) is connected to the Circular Actuator Middle (31). As the Handle (40) is rotated counterclockwise, the Circular Actuator Middle (31) rotates counterclockwise. This rotation lowers the upper Barricade Pivot Link (30), causing Circular Actuator—Upper (32) to rotate counterclockwise and extend the Upper Barricade (10) in the Barricade Latches (50). This simultaneously raises the lower Barricade Pivot Link (30), causing Circular Actuator—Lower (33) to rotate counterclockwise and extend the Lower Barricade (20) into the Barricade Latches (50).

The barricade is unlocked/deactivated by turning the Handle (40) clockwise, returning the Upper Barricade (10) and Lower Barricade (20) to the unlocked position.

Figure 5:
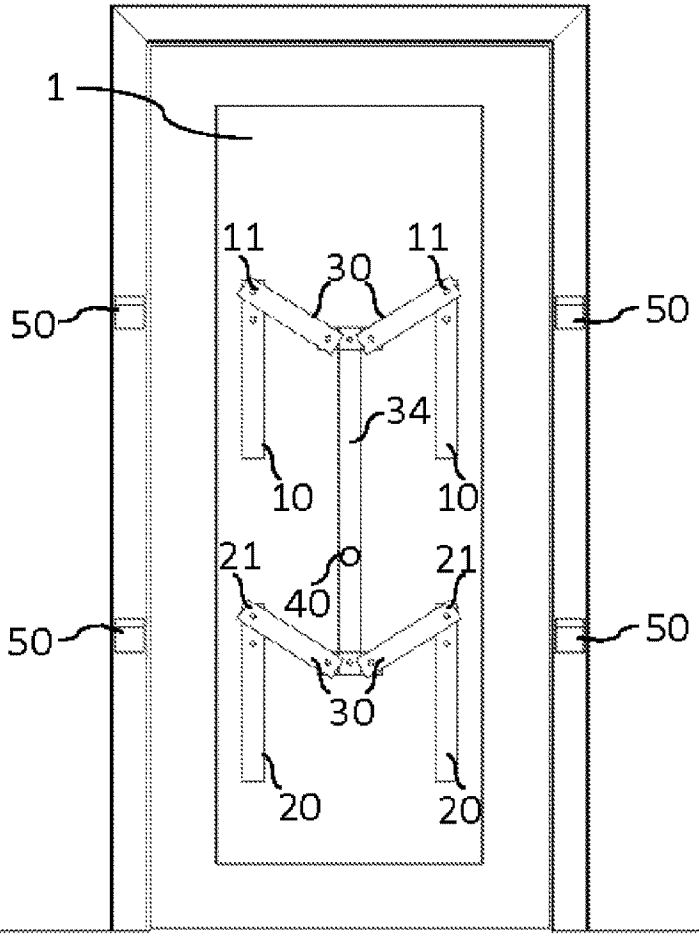
FIG. 5 shows a frontal view of the third primary embodiment of the present invention in the unlocked position.
Figure 6:
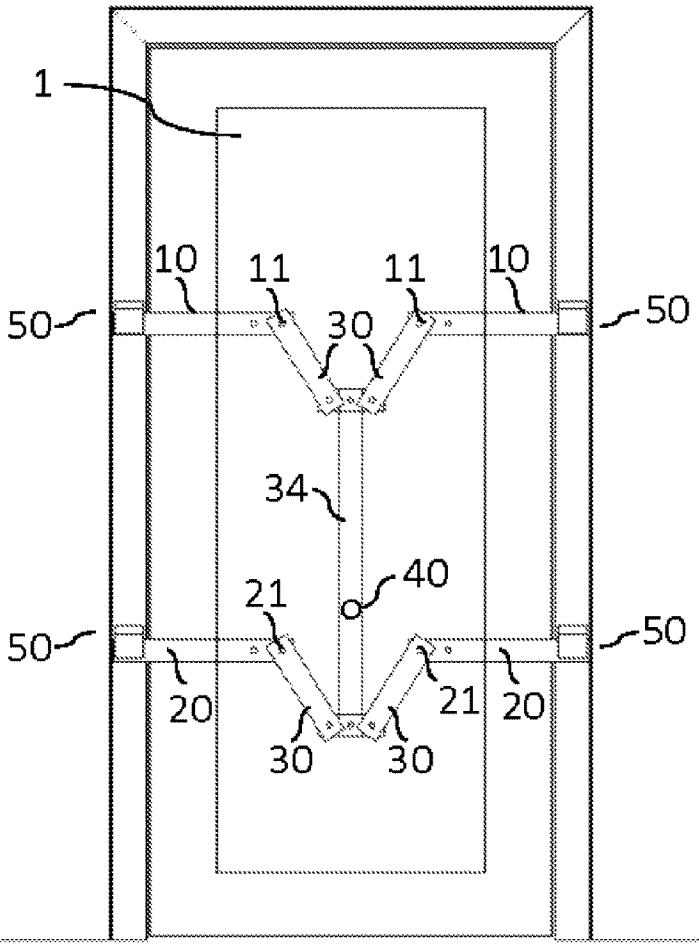
FIG. 6 shows a frontal view of the third primary embodiment of the present invention in the locked position.

The third preferred embodiment of the present invention, illustrated in FIGS. 5 and 6, is activated by pushing the Handle (40) downward. This motion causes Barricade Pivot Link (34) to move downward, which in turn moves the Upper and Lower Barricade Pivot Links (30) downward, which forces the Upper Barricade (10) and Lower Barricade (20) to rotate outward into the Barricade Latches (50). The barricade is unlocked/deactivated by moving the Handle (40) upward, which reverses the action and causes the Upper Barricade (10) and Lower Barricade (20) to return to the unlocked position.

The process of installation of the present invention is preferably as follows:

1. The customer acquires the present invention via purchase from a retailer or e-retailer.
2. The customer unpacks the components of the present invention from the packing.
3. The customer hangs the apparatus on the interior side of the door with a door mount, such as a suitable aeneric bracket (not shown)
4. The customer centers the apparatus on the door and uses the included mounting supplies to hold the apparatus in place.
5. If not preinstalled, the customer installs the handle (40) to the upper barricade (10) and secondary handle (45) to the lower barricade (20).
6. The upper barricade (10) and lower barricade (20) are then positioned such that they are horizontal, and cross the door frame perpendicularly.
7. A barricade latch (50) is mounted with the open end facing upwards on the side of the door frame, opposite of the door knob, below the upper barricade such that the upper barricade rests within the barricade latch.
8. A barricade latch is mounted with the open end facing upwards on the side of the door frame, opposite of the door knob, below the lower barricade such that the lower barricade rests within the barricade latch.
9. A barricade latch is mounted with the open end facing down on the side of the door frame, nearest the door knob, above the upper barricade such that the upper barricade rests within the barricade latch, entering the barricade latch from the bottom.
10, A barricade latch is mounted with the open end facing down on the side of the door frame, nearest the door knob, above the lower barricade such that the lower barricade rests within the barricade latch, entering the barricade latch from the bottom.

The device will now effectively barricade the door by moving the handle (40) and/or secondary handle (45) into the locked position. The barricade can be easily and quickly unlocked/deactivated by moving the handle (40) or secondary handle (45) into the unlocked position.

Additionally, the preferred process of use of the present invention is as follows:

1. First, the user enters the room and closes the door.
2. Then, the user grasps the handle (40) or the secondary handle (45) and moves it into the locked position.
3. The use of the door knob lock and/or deadbolt lock of the door is optional.

In the alternate primary embodiment of the present invention shown in FIG. 4, the user simply turns the handle (40) or similar handle disposed in the center of the door to rotate the central pivot point to move the upper barricade (10) and lower barricade (20) simultaneously into the barricade latches (50). (330)

Alternate embodiments of the present invention include variations on the style, material, color, thickness, and length of the upper barricade (10) and lower barricade (20). In the preferred embodiment of the present invention, the upper barricade (10) and lower barricade (20) are made of metal, and are preferably rectangular or square tubing. It should be noted that, in the preferred embodiment of the present invention, the barricade latches (50) are preferably mounted to the door frame with three screws or lag bolts (60) for each of the four barricade latches (50).

In some embodiments of the present invention, the casing, amounting to the inner case (1) and the outer case (2), are preferably planar. As such, in such embodiments the inner case (1) is preferably a planar panel to be mounted directly to the inside of the door, and the outer case (2) is configured as a aesthetic covering, also amounting to a planar panel designed to obscure the contents of the casing—namely the upper barricade (10), lower barricade (20), barricade pivot links (30), circular actuators (31, 32, 33), and other components of the present invention. It should be understood that the handle(s) (40) preferably protrude out from holes within the outer case (2).

Having illustrated the present invention, it should be understood that various adjustments and versions might be implemented without venturing away from the essence of the present invention. Further, it should be understood that the present invention is not limited to the invention as described in the embodiments above, but further comprises any and all embodiments within the scope of this application, including the incorporation of these or similar designs into the actual door itself.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

We claim:

1. A door barricade system comprising:

a casing, wherein said casing includes an inner casing and an outer casing, wherein said inner casing is configured to be contiguous to a door, and said outer casing being in communication with said inner casing such that the components of said barricade system can be disposed within said casing;

a first barricade, said first barricade disposed within said casing and configured to be pivotal mounted relative to said casing;

a second barricade, said second barricade disposed within said casing and configured to be pivotal mounted relative to said casing;

a door mount, said door mount comprising a bracket in communication with said casing, wherein said door mount is configured to mount said casing to said door;

one or more barricade pivot links, each of said one of more barricade pivot links being in direct communication with each of said first barricade and said second barricade such that said first barricade and said second barricade are linked together to pivot in tandem relative to the casing;

wherein said first barricade, said second barricade, and said one or more barricade pivot links are disposed within said casing;

at least one handle, each of said at least one handle protruding out through at least one respective corresponding slot in said outer casing;

a first barricade latch, said first barricade latch in communication with said first barricade when said first barricade is in a locked position;

a second barricade latch, said second barricade latch in communication with said second barricade when said second barricade is in a locked position;

wherein said first barricade latch and said second barricade latch are configured to be disposed on a frame of the door;

wherein each of said at least one handle is in communication with one of said at least one barricade pivot links and/or in communication with one of said first barricade or said second barricade;

wherein said first barricade is configured to pivot into a locked position in tandem with said second barricade via said one or more barricade pivot links; and wherein moving either of said at least one handle from a first handle position to a second handle position within said respective corresponding slot facilitates pivotal movement of said first barricade and said second barricade into the locked positions within each of said first barricade latch and said second barricade latch respectively, thereby securing said door.

2. The system of claim 1, wherein said first barricade and said second barricade extend out of sides of said casing when said first barricade and said second barricade are in a locked position; and wherein said first barricade and said second barricade remain concealed within said casing when said first barricade and said second barricade are in an unlocked position.

3. The system of claim 2, wherein said casing is disposed at an inside of the door.

4. The system of claim 2, wherein said first barricade and said second barricade are composed of wood.

5. The system of claim 2, wherein said first barricade, said second barricade, and said barricade pivot links are composed of metal.

6. The system of claim 2, wherein said first barricade is configured to move in step with said second barricade via said barricade pivot links; and wherein there are four barricade latches, two disposed on each the left side and the right side of the door frame to receive said first barricade and said second barricade when moved into the locked position.

7. The system of claim 2, further comprising:

a circular actuator;

wherein said circular actuator is in direct communication with said barricade pivot links;

wherein said circular actuator facilitates rotation of said first barricade and said second barricade into the locked position when manipulated via said at least one handle; and wherein said circular actuator facilitates rotation of said first barricade and said second barricade into the unlocked position when manipulated via said at least one handle.

8. The system of claim 1, wherein said casing is disposed at an inside of the door.

9. The system of claim 8, wherein said first barricade is disposed at a top of said inner casing; and wherein said second barricade disposed at a bottom of said inner casing.

10. The system of claim 1, wherein said first barricade is disposed at a top of said inner casing.

11. The system of claim 1, wherein said second barricade disposed at a bottom of said inner casing.

* * * * *